United States Patent [19]

Zenon

[11] 3,992,332

[45] Nov. 16, 1976

[54] LIQUID COMPOSITION FOR FABRIC TREATMENT

[76] Inventor: Hemson Joseph Zenon, 2123 N. 68th, Hillsdale, Mo. 63121

[22] Filed: Aug. 22, 1974

[21] Appl. No.: 499,513

[52] U.S. Cl. ..... 252/548; 252/8.8; 252/8.9; 252/DIG. 1; 252/DIG. 14; 252/DIG. 17

[51] Int. Cl.[2] ..... C11D 1/83; D06M 7/00; D06M 13/40

[58] Field of Search ..... 252/8.9, 8.8, 548, DIG. 17, 252/DIG. 1, DIG. 14, 8.6

[56] References Cited

UNITED STATES PATENTS

| | | | |
|---|---|---|---|
| 3,299,123 | 1/1967 | Fitch et al. | 252/DIG. 17 |
| 3,594,322 | 7/1971 | Wilson | 252/548 X |
| 3,707,502 | 12/1972 | Rawlinson | 252/548 X |
| 3,743,688 | 7/1973 | Nicholson et al. | 252/DIG. 17 |
| 3,828,087 | 8/1974 | Pitman et al. | 252/8.9 X |
| 3,844,952 | 10/1974 | Booth | 252/8.6 |
| 3,871,909 | 3/1975 | Aldrich | 252/8.8 |
| 3,896,032 | 7/1975 | Stroh et al. | 252/8.6 |
| 3,896,033 | 7/1975 | Grimm | 252/8.8 |

*Primary Examiner*—Thomas J. Herbert, Jr.
*Attorney, Agent, or Firm*—Michael Kovac

[57] ABSTRACT

A liquid composition for treatment of fabrics is disclosed as having a silicone glycol copolymer of nonionic series, a phosphate derivative of anionic series, and a compatible liquid base. Other beneficial ingredients may include a detergent, emollient, color, perfume, thickeners, liquid softening agents and soil retardants.

3 Claims, No Drawings

LIQUID COMPOSITION FOR FABRIC TREATMENT

SUMMARY OF THE INVENTION

A variety of natural and man-made fibers have been used to produce clothing, sheets, towels and the like. In the development or selection of fibers for the manufacture of such articles, consideration has been given to factors that enhance the wearing or use and life of such articles. In order to reduce the time required for laundering or pressing such articles, consistent with the desired of homemakers and industrial cleaners, manufacturers have also developed so-called permanent press, knit garments and other articles that do not require the use of starch to give body to the articles or do not require pressing. Efforts will continue in the development of articles that wear well, have excellent durability, and require little time and effort in reconditioning after use.

There has been a proliferation of products for reconditioning clothing, hosiery, towels, sheets and the like after use for both consumer and industrial applications. These have included pre-soak products, detergents, bleaches, starches, softeners, anti-static agents and the like. While many of the reconditioning products are effective in limited applications for certain articles, the great variety of fabrics available and the condition of the fabric themselves makes it difficult with currently available reconditioning products, to enhance the wearing or use and life of such fabrics. Further, the method of application of the currently available reconditioning products can be time consuming, inconvenient and generally unsatisfactory for what can be achieved.

As an example, some fabric softeners which are added directly to the wash cycle in washing machines do not produce the softness of those fabric softeners added during the rinse cycle of washing machines and yet products of the latter type require that users make themselves available to interrupt the operation of the washing machine at a time which may be inconvenient. With certain types of man-made fibers as well as natural fibers, an anti-static agent may also be desirable, but this may require additional time and effort to add an anti-static agent to the washer or dryer, not to mention added cost.

Up to the present time, there has been no reconditioning product available which enhances the wearing or use and life of fabrics and at the same time, minimizes the time and effort required during reconditioning of the fabrics as well as assists in the reconditioning of fabrics.

Accordingly, it is an object of the present invention to provide a new and improved composition for treatment and reconditioning of fabrics.

More specifically, it is an object of the present invention to provide a liquid composition for treatment and reconditioning of fabrics which achieves some or all of the following: is compatible with laundry detergents and bleaches for washing machines; enhances the cleaning power of detergents and bleaches; reduces the amount of bleaches and detergents used; requires far less or no extra preparation prior to re-washing; may be used by itself for hand washing; softens fabrics without artificial surface feel; reduces wrinkles; reduces lint; is an anti-static agent and reduces static cling; facilitates ironing, is a dirt and stain inhibitor; reduces friction between potentially snagging object and fibers and also reduces fiber to fiber friction; reduces pilling, fraying, pulling and snagging; and provides renewed color and appearance of older garments.

These and other objects and advantages of the present invention are attained by providing a liquid composition for fabrics which include, in its simplest form a silicone glycol copolymer of nonionic series, a phosphate derivative of the anionic series, and a compatible liquid base; in other forms, it may also include detergents, emollients, color, perfume, thickeners, liquid softening agents and soil retardants in desired amounts.

GENERAL DESCRIPTION OF PREFERRED EMBODIMENTS

In the description that is to follow, it is to be understood that the liquid fabric treatment of the present invention may be used in home and industrial washing machines or may be used in hand washing operations. Generally, the liquid fabric treatment may be used by itself for hand washing or delicate fabric machine washing, while for normal machine washing operations, the liquid fabric treatment is compatible with and enhances the cleaning power of liquid or powder detergents, as will become apparent.

The liquid composition fabric treatment of the present invention is used for enhancing the wearing or use and life of the fabric. This is achieved by reducing fiber tension and fiber friction between the fiber and potentially snagging objects as well as fiber to fiber friction. At the same time, the fabric treatment softens the fabric while reducing static electricity in the fabric. In addition to fabric treatment, the liquid composition of the present invention assists in the reconditioning of fabrics during hand or machine washing thereof by its compatibility with laundry detergents and bleaches while enhancing the cleaning power of detergents and bleaches even with smaller amounts of detergents and bleaches. Numerous other properties and advantages of the present invention will become apparent from the ensuing description.

The liquid composition of the present invention includes a silicone glycol copolymer of nonionic series, a phosphate derivative of anionic series, and a compatible liquid base. Additionally, the liquid composition may include a detergent, an emollient, color, perfume, thickeners, liquid softening agents and soil retardants.

The silicone glycol copolymers are selected from the group consisting of polyoxyethylene polymethylsiloxane, polyethylene polyoxypropylene polymethylsiloxane, polyoxyenthylene polyoxypropylene polymethysiloxane. The silicone glycol copolymers were selected for their low surface tension and low fiber to surface and fiber to fiber friction qualities. The low surface tension qualities allow better coating and adhesion to individual fibers while the low fiber to surface and fiber to fiber friction qualities reduce pilling, fraying, pulling and snagging of fibers that relate to the wearing or use and life of fabrics. In addition, the nonionic or neutrally charged particles of the silicone glycol copolymer makes it compatible with the anti-static agent of the present invention as well as with detergents and bleaches.

The anti-static phosphate derivative of anionic series is selected from the group consisting of alkyl phosphate esters. This compound group allows the free acids as well as the neutralized products to be effective. The properties of the neutralized products differ from the free acids dependent on the neutralizing reactant. Organic as well as inorganic salts may be employed. The multiplicity of variables in natural and man-made fabrics may require modification of the properties of the anti-statics in order to improve their effectiveness. The potassium salt of alkyl ester of phosphoric acid offers optimum properties on most synthetic fibers.

The anti-static phosphate derivative of anionic series is an anti-static binding agent that is surface active. Its' anti-static qualities enable it to reduce static cling in fabrics. As a laundring agent, it provides compatibility between the other ingredients of the liquid composition of the present invention as well as detergents and bleaches by its anionic or negatively charged particles which allow it to be directly combined with washing detergents. Most fabric softeners are made from fatty acids (stearie, coconut, etc.) that possess cationic or positive charges and this renders the fabric softeners incompatible with laundry detergents. As a result, most other fabric softeners must be added to fabrics only after detergents are removed, such as in the rinse cycle of washing machines. The phosphate derivative of anionic series in combination with the silicone glycol copolymer of nonionic series in the liquid composition of the present invention enbles detergents to be used directly therewith in the washing of fabrics, such as in the wash cycle of washing machines, without interfering with the silicone glycol copolymer action as discussed above.

In conjunction with the silicone glycol copolymers of nonionic series and the phosphate derivative of anionic series, a compatible liquid base such as water is used.

It has been discovered that a highly effective liquid composition of the present invention may be made with the following ingredients by percentage weight: 1 to 10% silicone glycol copolymer of nonionic series, 5 to 20% anti-static phosphate derivative of anionic series and from 70 to 94% compatible liquid base such as water. The above ranges determine the effectiveness and economics of any liquid composition that is desired to be made within the predetermined ranges.

A mild cleaner or detergent is usefully employed in the form of a coconut fatty acid alkanolanide with a percentage by weight of 0.5 to 5% which would replace an equivalent weight by percentage of compatible liquid base in the aforementioned composition. In addition to serving as a mild cleaner or detergent, the coconut fatty acid alkanolanide is a corrosion inhibitor for metal parts in the washing machine, provides softening properties to the skin when the liquid composition is used as a hand wash, and serves as an emulsifier which helps during rinsing of fabrics.

Further beneficial ingredients may include emollients of the polyhydroxy alcohol series such as propylene glycol, glycerine, diethylene glycol, etc; water compatible types or water dispersible types such as lanolin, merial oil, mink oil or other similar animal, mineral or vegetable oils. Additionally, color, perfume, thickeners, water softening agents and soil retardants may be added to the above composition. From 0.1 to 10% emollient, colorant, perfume, thickener, water softening agent and soil retardant may be added to replace equivalent weights by percentage of compatible liquid base in the composition.

In manufacturing the liquid composition of the present invention, the silicone should be added to the water first followed by glycol and alkanolanide. The anti-static agent phosphate derivative, perfume, color, thickeners, water softening agents and soil retardants may then be added. The ingredients are added in the manner set forth above in order to avoid solubility complications.

Tests performed on garments with the liquid composition of the present invention have revealed numerous properties and advantages in the wearing or use and life of the fabrics as follows: softeness of fabrics without artificial surface feel; reduction of lint, wrinkling and static cling; reduction in dirt and stain penetration; reduction of friction between potentially snagging objects and fibers as well as fiber to fiber friction; reduction of pilling, fraying, pulling and snagging of fabrics; renewed color and appearance of older garments; greater ease of movement, less stiffness and less scratchy feel in fabrics.

In addition to the wearing or use and life of fabrics it has been learned through tests that the liquid composition of the present invention greatly assists in the reconditioning of fabrics as follows: provides compatibility with detergents and bleaches during washing of fabrics; enhances the cleaning power of detergents and bleaches; reduces the amount of detergents and bleaches needed; requires far less or no extra preparation of fabrics prior to re-washing; and may be used by itself for hand washing or with laundry detergents and bleaches in washing machines.

From the foregoing, it will be appreciated that the liquid composition of the present invention enhances the wearing or use and life of fabrics while assisting in the reconditioning of fabrics in a manner not heretofore contemplated.

I claim:

1. A water soluble composition for treating fabrics including at least 1% by weight of a water soluble silicone glycol copolymer of nonionic series selected from the group consisting of polyoxyethylene polymethylsiloxane, polyethylene polyoxypropylene polymethylsiloxane and polyoxyethylene polyoxypropylene polymethylsiloxane, at least 5% by weight of a fiber coupling and anti-static agent including a phosphate derivative of anionic series selected from the group consisting of alkyl phosphate esters, and at least 70% by weight of water.

2. The composition as defined in claim 1 wherein the weight of ingredients additionally consists of at least 0.5% detergent from the group consisting of coconut fatty acid alkanolanide.

3. The composition as defined in claim 2 wherein the weight of ingredients consists of from 1 to 10% silicone glycol copolymer of nonionic series, from 5 to 20% fiber coupling anti-static phosphate derivative of anionic series, from0.5 to 5% detergent, and from 55 to 93.4% water.

* * * * *